United States Patent [19]

Chang

[11] 4,391,612

[45] Jul. 5, 1983

[54] GASIFICATION OF COAL

[75] Inventor: Tsuan Y. Chang, Baldwin, N.Y.

[73] Assignee: The Halcon SD Group, Inc., New York, N.Y.

[21] Appl. No.: 267,959

[22] Filed: May 28, 1981

[51] Int. Cl.[3] ..... C10J 3/54

[52] U.S. Cl. ..... 48/202; 48/206

[58] Field of Search ..... 48/202, 203, 210, 206; 201/31; 252/373

[56] References Cited

U.S. PATENT DOCUMENTS

| | | | |
|---|---|---|---|
| 2,716,055 | 8/1955 | Pearce | 48/206 |
| 2,741,549 | 4/1956 | Russell | 48/206 |
| 3,171,369 | 3/1965 | Stephen, Jr. et al. | 48/206 |
| 3,985,519 | 10/1976 | Kalina et al. | 48/210 |
| 4,046,523 | 9/1977 | Kalina | 48/202 |
| 4,261,856 | 4/1981 | McMinn, Jr. | 252/373 |

FOREIGN PATENT DOCUMENTS

| | | | |
|---|---|---|---|
| 533776 | 11/1956 | Canada | 48/206 |
| 2515858 | 10/1975 | Fed. Rep. of Germany | 48/202 |
| 49-56889 | 3/1974 | Japan | 252/373 |

*Primary Examiner*—William F. Smith

*Attorney, Agent, or Firm*—William C. Long; Riggs T. Stewart; Harold N. Wells

[57] ABSTRACT

A gaseous effluent rich in hydrogen and carbon monoxide is produced from coal by a process which involves the gasification of the coal in a fluidized gasification zone interconnected with a combustor zone comprising a combustion unit and an entrained flow lift column with transfer of solid material between the gasification zone and the combustor zone, in a system in which lime-treated coal and steam are fed to the gasification zone to which heat is supplied by clinker material transferred from the combustor zone. At the same time, gasified coal residue or "char" and clinker are transferred from the gasification zone to the combustor zone wherein the char is brought into contact with air in the presence of the clinker particles circulating from the bottom of the gasification zone, and the final gas and heat values from the coal are extracted by combustion of the char, the coal ash with the lime emerging as fine particles. Heat from the combustion of the char is absorbed by the circulating clinker in the combustion unit and in the lift column of the combustor zone and this heat is transferred to the gasification zone when the clinker is supplied to it. The clinker transferred to the gasification zone, in accordance with the invention, has a predetermined particle size of the order of 1/32 inch to ¼ inch and represents clinker which is removed from the combustor zone by the action of the rising gases. The thus gas-transported clinker is separated from "fines." The separated clinker particles are transferred to the gasification zone to supply required heat.

2 Claims, 1 Drawing Figure

GASIFICATION OF COAL

Figure 1:
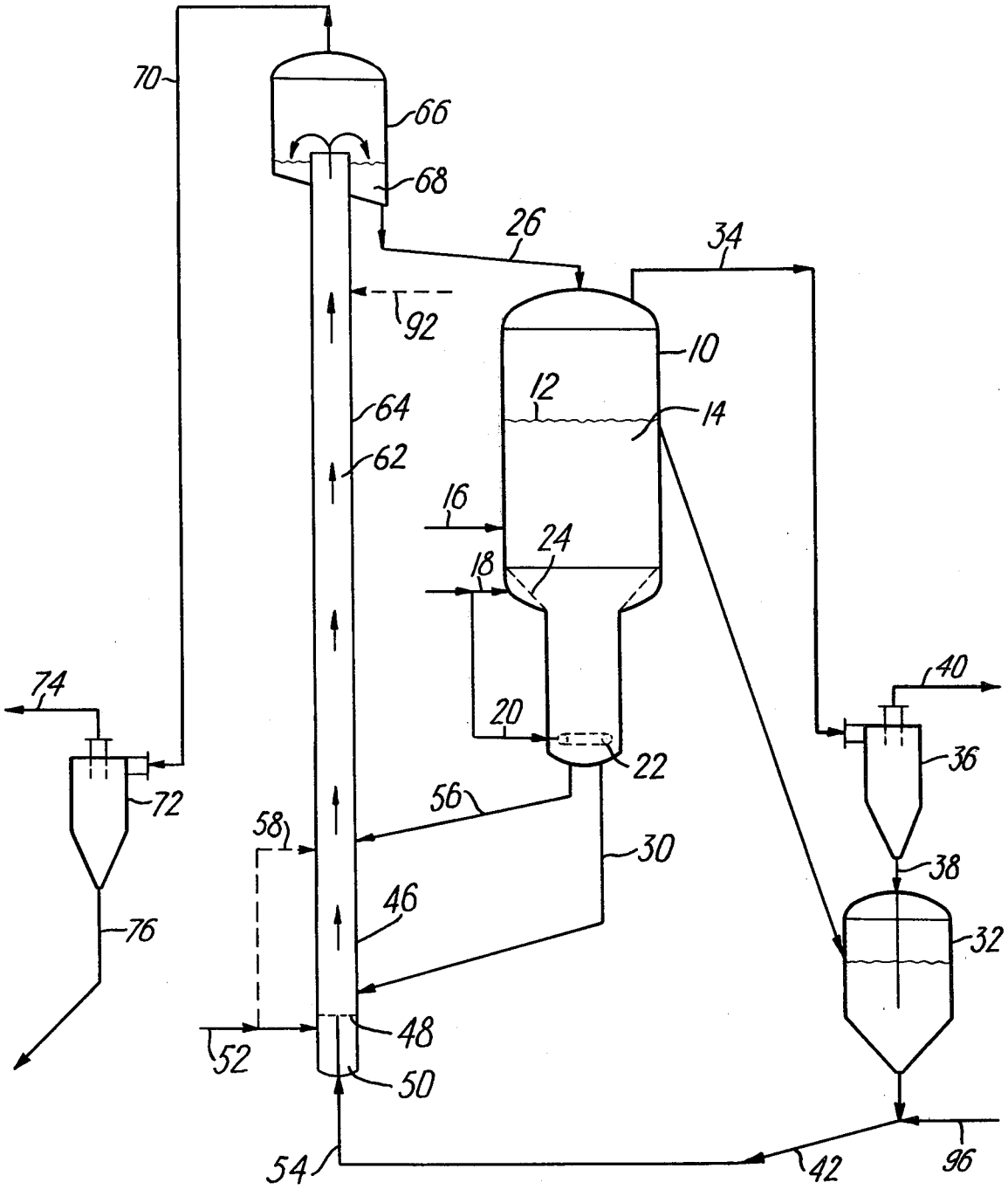

This invention relates to coal gasification and is more particularly concerned with a process wherein maximum gasification and utilization of the heat values of the coal are realized.

The gasification of coal in fluid-bed systems has been known for many years and various proposals have been advanced. In this connection reference is made to U.S. Pat. Nos. 3,171,369 and 3,437,561 and work done by the British Coal Utilization Research Association described in an article by S. Wright et al. in the Journal of the Institute of Fuel, Volume 42, pages 235–239 (1969). A widely-publicized prior art system is the Winkler process in which fine fuel is gasified in a fluidized bed. A description and discussion of this process can be found in "Industrial and Engineering Chemistry, Volume 40, Number 4, (April 1948), page 562 et seq." More recently, fluid bed coal gasification and combustion systems have been described in "Environmental Science and Technology, Volume 11, Number 3 (March, 1977), pages 244–248" and in an article by W. M. Goldberger in the American Institute of Chemical Engineers Symposium Series Volume 70, Number 141, pages 88–96.

While these previously-disclosed processes are effective for their intended purposes, there is a continuing need for improved processes wherein maximum gasification and maximum utilization of the heat values of the coal are realized since, when coal is burned and gasified, it is important to recover the maximum amount of gas and heat energy available in the coal. This need grows greater every day. With the rapid depletion of natural gas reserves and the growing worldwise limitation of petroleum as a major source of fuel, attention has recently been focused on the prodigious coal reserves in the United States and there has been renewed interest in the gasification of coal as a source of fuel.

It is accordingly an object of the present invention to provide a coal gasification process wherein valuable gaseous products are recovered from the coal and maximum utilization of the heat energy contained in the coal is achieved.

In accordance with the invention, coal gasification is carried out in a fluidized gasification zone interconnected with a combustor zone comprising an entrained flow lift zone, with transfer of solid material between the gasification zone and the combustor zone, in a system in which lime-treated coal and steam are fed to the gasification zone to which heat is supplied by clinker material transferred from the combustor zone. At the same time, gasified coal residue or "char" and clinker are transferred from the gasification zone to the combustor zone wherein the char is brought into contact with air in the presence of the clinker particles circulating from the bottom of the gasification zone, and the final gas and heat values from the coal are extracted by combustion of the char. Heat from the combustion of the char is absorbed by the clinker in the combustor zone and this heat is transferred to the gasification zone when the clinker is supplied to it. The clinker transferred to the gasification zone, in accordance with the invention, has a predetermined particle size of the order of 1/32 inch to ¼ inch and represents clinker which is lifted in the combustor zone by the action of the rising gases. The thus gas-transported solids are separated into clinker particles and "fines" and the clinker particles are transferred to the gasification zone to supply the required heat. More particularly, the process of the invention comprises:

(a) feeding clinker particles and char from the partial gasification of lime-treated coal, and air to a combustor zone operating at a temperature of 900° C. to 1300° C.;

(b) elevating said clinker particles and any "fines" present by the action of a gaseous stream comprising any excess air and the gases produced by the combustion of the char to a clinker separation zone;

(c) separating the thus-elevated particles and fines in the separation zone into a stream of fines which are suspended in and carried away by the gaseous stream, and a body of clinker particles deposited from the gaseous stream;

(d) feeding the deposited clinker particles to the upper portion of a gasification zone while feeding lime-treated coal and superheated steam into the lower portion of the gasification zone, the unreacted steam and the gases resulting from the gasification of the lime-treated coal maintaining a fluidized bed comprising said lime-treated coal and the char produced by the partial gasification of the lime-treated coal, with said clinker particles raining down through said fluidized bed as a separate phase, the clinker particles and the steam supplying the heat for the gasification reaction to maintain the fluidized bed at a temperature of 700° C. to 1050° C. (e) removing the fuel gas generated in the gasification zone by the partial gasification of the lime-treated coal in the presence of steam, removing the char from the upper portion of the fluidized bed in the gasification zone, removing the clinker particles from the lower portion of the gasification zone, and;

(f) passing the clinker and char removed from the gasification zone to the combustor zone to provide the feed of char and clinker particles for step (a).

In a preferred embodiment of the invention, the fuel gas removed from the gasification zone is treated to remove any char entrained with it and the char is combined with char removed in step (e) and fed to the combustor zone in step (f). The gases removed from the clinker separation zone at the top of the combustor column and containing entrained fines can be treated to recover the fines and the hot gases can be utilized to recover their contained heat.

It will be seen that there is thus provided an integrated continuously circulating system which can produce maximum gas values and recover maximum heat energy from the coal fed to the system while using only steam and air as fluidizing and reacting gaseous media. As mentioned, lime is supplied to the system as a component of lime-treated coal being fed for gasification.

As a result of these integrated, interconnected gasification and combustion reactions with controlled flow of materials between the gasification zone and the combustor zone, it is possible to ensure essentially complete combustion and gasification and to increase the recovery of gas and heat values from the coal. As described below, the lime is recovered in the form of a useful product while, as previously mentioned, only coal, lime, air and steam are fed to the system.

These and other advantages and features of the invention will be more readily apparent from the following detailed description of the invention, taken with particular reference to the accompanying drawing wherein, FIG. 1 is a diagrammatic flow representation of an illustrative embodiment of the process of the invention showing a typical arrangement of apparatus units in which the process is suitably carried out.

Referring to FIG. 1, wherein the reference numeral 10 designates a vessel defining a fluid-bed gasification zone showing at 12 the upper level of a fluidized bed 14 into which is introduced via line 16 a stream of lime-treated coal to be gasified and into which is also introduced superheated steam via lines 18 and 20, the steam entering at 20 passes into a distributor ring 22 and the steam entering at 18 passing through an apertured annular ring indicated by line 24 in order that the steam will be well distributed in the body of the fluid bed 14 and will be effective to fluidize the bed as well as to take part in the gasification reaction. Some heat is supplied by the superheated steam, which is suitably at a temperature of 430° C. to 760° C. and under a pressure of 50 psig to 150 psig, but the major part of the heat for the gasification reaction is supplied by hot clinker particles entering via line 26. The gasification zone as shown in the embodiment illustrated advantageously has a lower portion of reduced diameter for reception of the clinker particles which have been cooled by reason of having given up a large part of their sensible heat in passing through the fluidized bed and are withdrawn via lines 30 and 56 to be supplied to a combustor zone as will be described below. The steam entering via line 20 serves to strip the accumulated clinker particles of any char which may have been entrained by them.

In the gasification zone which is operated at a temperature of 700° C. to 1050° C., preferably 850° C. to 1000° C. and at a pressure of 50 to 150 psig, preferably 80 to 120 psig, the lime-treated coal undergoes partial gasification in the presence of the steam to produce a gaseous product composed primarily of hydrogen and carbon monoxide with minor amounts of carbon dioxide and methane along with hydrogen sulfide representing the sulfur contained in the coal. The residue of the thus partially gasified coal, or "char," is a lightweight material which is drawn off as overflow from the bed. This char together with the previously-mentioned cooled clinker is supplied to the combustor zone to be described. Conveniently, the char is accumulated in a char accumulator 32. The product gas is removed from the top of gasifier 10 via line 34 and, since it generally has entrained with it small particles of the char, it is conveniently passed through a cyclone 36 wherein the char is separated and passes via line 38 to char accumulator 32 while the purified gaseous product is removed via line 40.

From the char accumulator 32, the char, which still contains gas and heat values, is passed via line 42 into a combustor unit 46 having a perforated grid 48 separating the upper portion of the unit from a plenum chamber 50 into which preheated air is introduced via line 52 for passage through the perforations in the grid 48. The char in line 42 passes into the combustor unit 46 through one or more pipes 54 (illustrated diagrammatically by a single line) which extend through the plenum chamber and the grid 48 into the combustor unit. At the same time, cooled clinker in lines 30 and 56 passes into the combustor unit 46. The air supplied via line 52 is preferably at a temperature in the range of from 250° C. to 500° C. and is introduced at a rate to react with the char entering via line 54 to maintain a temperature of from 900° C. to 1300° C. in the combustor zone. The combustor zone is maintained at a pressure of 50 to 150 psig, preferably 80 to 120 psig. In the combustor zone, the char is combusted to release its remaining gas values and its heat values and the resulting ash containing the lime from the char becomes the product fines and the heat of combustion heats the circulating clinker entering via line 30 and line 56.

The heated clinker is then treated to remove fines and to provide a heated body of clinker particles of size 1/32 inch to ¼ inch to be fed to the gasification zone to supply heat thereto. In order to effect the above-mentioned separation of the fines from particles of the indicated particle size for supplying to the gasification zone, the combustion product gas and any excess air lift the fines and the circulating clinker particles through the entrained flow lift zone 62 of the combustor zone, defined by a column 64, to a separator 66 of larger diameter than the column 64 in which the circulating clinker particles drop from the gaseous stream into a bed 68 which communicates with line 26 previously described. The existing gases containing the entrained fines from which the clinker particles have been separated passes via line 70 to a cyclone separator 72 in which the fines are removed from the flue gas which leaves the separator 72 via line 74. The flue gas is suitably utilized to recover its heat content. The ash fines are withdrawn from separator 72 via line 76.

The recovered fines can be further processed to make clinkers suitable for use as cement blending stocks by any of the known clinkering methods. Alternatively, the ash fines can be melted and water quenched to produce pellets suitable for cement manufacture. A small portion of these clinkers or pellets can be used as make-up for the loss of the circulating clinkers due to attrition resulting from normal operation of the gasifier-combustor system. Thus, the plant is self-sufficient as far as the supply of the heat-transfer clinker particles is concerned.

It will be understood that in starting up the process, a bed of clinkers of the desired particle size is initially charged to combustor unit 46. These clinkers can be prepared in any convenient way by calcining the coal ash which contains the lime, e.g., in a rotary calciner or in a fluid bed calciner or in some other way such as melting the ash and then prilling or water quenching the molten ash to form clinker pellets. The clinker bed is initially heated and lifted with flue gas or the like in accordance with usual techniques for starting up reactors and circulation of clinkers is begun, followed by initiating the feed of the various feed materials.

The coal employed in the process of this invention can be any solid coal-like carbonaceous material such as subituminous coals (e.g., peat, lignite, or brown coal); bituminous coals, including the highly volatile and caking coals; anthracite coals; coke and charcoal. A mixture of solid and liquid fuels can also be used, e.g., a mixture of coal and heavy oil. The coal used is suitably of a particle size ranging from smaller than 6 U.S. Mesh to smaller than 60 U.S. Mesh, preferably smaller than 20 U.S. Mesh. The coal is, as previously mentioned, treated with lime in any suitable manner to provide a ratio of lime to coal of 2 to 30 weight percent, preferably 4 to 10 weight percent. Conveniently, the lime is added to the coal in the form of milk of lime which is mixed with the coal in an amount to provide the above-mentioned relationship of lime to coal and the resulting mixture is then dried, e.g., to a moisture content of 2 weight percent to 6 weight percent. Conveniently, the flue gas removed via line 74 can be employed for drying the lime-treated coal particles, after first passing through other heat recovery devices.

One of the features of the process of the invention is that the sulfur content of the coal is converted under the conditions of reaction in the gasification zone to $H_2S$ which is readily removed from the resulting gas stream by conventional means well known to persons skilled in the art.

As will be apparent from the foregoing, the process of the invention lends itself to the production of fuel gas or synthesis gas and the relative ratios of coal to steam are readily adjusted to vary the relative content of the hydrogen and carbon monoxide in the product gas stream removed via line 34 from the gasification zone. The gas produced is essentially nitrogen-free and has a low carbon dioxide content. As will also be apparent from the foregoing, air is completely suitable for carrying out the combustion reactions and recourse to oxygen and oxygen-enriched air, as is common in prior art processes, is not necessary, and the required heat for the endothermic reaction taking place in the gasification zone is readily supplied by means of the circulating clinker stream which absorbs heat in the combustor zone and transfers it to the gasification zone in an integrated combustion-gasification system having advantageous economic consequences and resulting in maximum recovery of the gas and heat values contained in the coal being treated.

While in the foregoing description, emphasis has been placed upon a typical system for carrying out the process of the invention, it will be apparent that the processing scheme is susceptible of a number of modifications and variations. For example, cooled flue gas can be supplied into column 64 as indicated diagrammatically at 92 to prevent, if necessary, any agglomeration of clinker particles in separator 66. Also, part of the preheated air used for char combustion, stream 52, can be introduced, if desired, at an elevation higher than the bottom distributor plate 48, as shown diagrammatically at 58. As will be apparent from the foregoing, the term "flue gas" is used herein to designate the gases rising from the combustor zone defined by combustor unit 46 and lifting column 64. This flue gas which transports the circulating particles of clinker and fines to the separation zone at the top of lifting zone 62 is at a highly elevated temperature of the order of 900° C. to 1300° C. and combustion of the char will be practically complete in lift zone 62.

Following the separation of the flue gas from the fines in separator 72, the flue gas is recovered via line 74 at a high temperature and it will be apparent that the heat contained in this flue gas can be used to advantage for various purposes connected with the operation of the process of the invention. In addition to use for drying the lime-treated coal, it can also be used for generation and superheating of steam, preheating of boiler feed water, and recovery of power by gas expansion turbines, and the like. One use illustrated in the drawing is for facilitating the movement of the char from unit 32 to unit 46, e.g., by introducing the gas via line 96.

It is apparent that there are other possible variations of the processing scheme, depending on the exact circumstances under consideration. For example, for the gasification of the coal, steam and carbon dioxide can be used instead of steam alone, in order to vary the $CO/H_2$ ratio in the product fuel gas. For the heat transfer medium between the combustor and the gasifier, sand or other suitable inert particles can be used instead of clinkers. If necessary, part of the char collected in cyclone 36 can be recycled to the gasifier instead of being all fed forward to the combustor unit 46.

EXAMPLE

The following example shows the production of medium BTU fuel gas from Illinois No. 6 coal. The numerial references correspond to those shown in the drawing.

Illinois No. 6 coal is mixed with milk of lime to provide about 5 pounds of lime per 100 pounds of dry coal. The mixture is dried to provide a lime-treated coal containing 4.8 weight % of water, which is fed to gasifier 10. The rate of coal feed to the gasifier is 100,000 lb./hr. of dry coal of the following analysis:

| | Wt. % |
|---|---|
| C | 68.64 |
| H | 4.59 |
| N | 1.66 |
| O | 8.49 |
| S | 4.23 |
| Ash | 12.39 |
| | 100.00 |

The lime-treated coal, stream 16, consisting of 100,000 lb./hr. of dry coal, 5,263 lb./hr. of water, and 5,000 lb./hr. of lime, is fed to the bottom of the gasifier. Also added to the gasifier bottom are 70,241 lb./hr. of steam, streams 18 and 20, superheated to 594° C. The steam and lime-treated coal react in the gasifier fluidized bed at 871° C. to produce raw fuel gas and unreacted char. The raw fuel, stream 34, leaves the top of the gasifier at 100 psig and has the following composition:

| Component | Lb Moles/hr | Mol % |
|---|---|---|
| $H_2$ | 4729 | 50.96 |
| CO | 2779 | 29.94 |
| $CO_2$ | 431 | 4.64 |
| $CH_4$ | 280 | 3.02 |
| $H_2S$ + COS | 106 | 1.14 |
| $NH_3$ | 6 | 0.06 |
| $N_2$ | 56 | 0.60 |
| $H_2O$ | 895 | 9.64 |
| | 9282 | 100.00 |

The unreacted char overflows from the top of the gasifier fluidized bed and, together with the fine char particles collected from the hot, raw fuel gas in cyclone 36, is fed to the combustor system as stream 42. The char feed rate, including the contained lime, is 45,008 lb./hr. Preheated air at 355° C., stream 52, is added below the distributor plate of the combustor. The total air rate is 11,354 lb moles/hr. with 137 moles/hr. of moisture. The flue gas, stream 70, leaves the elevated separator at 100 psig and about 1232° C. It passes through cyclone 72, a heat-recovery system, a gas expander, and the dryer for the lime-treated coal. The flue gas has the following composition:

| Component | Lb Moles/hr | Mol % |
|---|---|---|
| $CO_2$ | 2231 | 19.53 |
| $N_2$ | 8915 | 78.05 |
| $O_2$ | 113 | 0.99 |
| $SO_2$ | 26 | 0.23 |
| $H_2O$ | 137 | 1.20 |

-continued

| Component | Lb Moles/hr | Mol % |
|---|---|---|
| | 11,422 | 100.00 |

The circulating clinkers between the gasifier and the combustor units (upper stream 26 and lower streams 30 plus 56) each flows at the rate of 1,250,500 lb./hr., based on a clinker inlet temperature of 1205° C. to the gasifier and an outlet temperature of 871° C. leaving the gasifier fluidized bed. The fines production, stream 76, is 17,390 lb./hr.

What is claimed is:

1. A process for the production of a gaseous effluent rich in hydrogen and carbon monoxide from coal which comprises the steps of:

(a) feeding (1) clinker particles and char from the partial gasification with superheated steam of lime-treated coal in a gasification zone, and (2) air to a combustor zone operating at a temperature of 900° C. to 1300° C.;

(b) elevating said clinker particles and any "fines" present by the action of a gaseous stream comprising any excess air and the gases produced by the total combustion of the char with air to a clinker separation zone, said fines comprising ash resulting from the combustion of said char in said combustor zone and lime contained in said coal;

(c) separating the thus-elevated particles and fines in the separation zone into a stream of fines which are suspended in and carried away by the gaseous stream as solid product, and a body of clinker particles deposited from the gaseous stream;

(d) feeding the deposited clinker particles to the upper portion of said gasification zone while feeding lime-treated coal and superheated steam into the lower portion of said gasification zone, the unreacted steam and the gases resulting from the gasification of the lime-treated coal maintaining a fluidized bed comprising said lime-treated coal and the char produced by the partial gasification of the lime-treated coal, with said clinker particles raining down through said fluidized bed as a separate phase, the clinker particles and the steam supplying the heat for the gasification reaction to maintain the fluidized bed at a temperature of 700° C. to 1050° C.;

(e) removing the fuel gas generated in the gasification zone by the partial gasification of the lime-treated coal in the presence of steam, removing the char from the upper portion of the fluidized bed in the gasification zone, removing the clinker particles from the lower portion of the gasification zone;

(f) passing the clinker and char removed from the gasification zone to the combustor zone to provide the feed of char and clinker particles for step (a);

(g) recovering the fines from the gaseous stream of step (c);

(h) preparing clinker particles from at least some of the fines recovered in step (g); and (i) introducing the clinker particles produced in step (h) to make up for the loss of clinker particles resulting from attrition.

2. A process as defined in claim 1, wherein the fuel gas removed from said gasification zone is treated to recover entrained char and said recovered char is fed to said combustor zone in step (f).

* * * * *